US006153256A

United States Patent [19]

Kambara et al.

[11] Patent Number: 6,153,256

[45] Date of Patent: Nov. 28, 2000

[54] CHIP RESISTOR AND METHOD OF MAKING THE SAME

[75] Inventors: Shigeru Kambara; Kaoru Sakai, both of Kyoto, Japan

[73] Assignee: Rohm Co., Ltd., Kyoto, Japan

[21] Appl. No.: 09/373,836

[22] Filed: Aug. 13, 1999

[30] Foreign Application Priority Data

Aug. 18, 1998 [JP] Japan ..... 10-231652
Dec. 24, 1998 [JP] Japan ..... 10-366515

[51] Int. Cl.[7] ..... B05D 5/12

[52] U.S. Cl. ..... 427/103; 427/102; 338/309; 29/613; 29/621

[58] Field of Search ..... 427/101, 102, 427/103; 29/610.1, 613, 621; 338/308, 309, 332

[56] References Cited

U.S. PATENT DOCUMENTS 5,450,055 9/1995 Doi ..... 338/332
5,815,065 9/1999 Hanamura .
5,990,781 11/1999 Kambara ..... 338/309

FOREIGN PATENT DOCUMENTS 4-102302 4/1992 Japan .

*Primary Examiner*—Brian K. Talbot
*Attorney, Agent, or Firm*—Merchant & Gould P.C.

[57] ABSTRACT

A chip resistor includes a spaced pair of main top electrodes on an insulating substrate, a resistor layer formed on the insulating substrate to bridge between the main top electrodes, an overcoat layer formed over the resistor layer, and a pair of auxiliary top electrodes formed on the main top electrodes in contact with the overcoat layer. Each of the auxiliary top electrodes contains a glass material in addition to a metal material for integration with the overcoat layer.

8 Claims, 4 Drawing Sheets

CHIP RESISTOR AND METHOD OF MAKING THE SAME

BACKGROUND OF THE INVENTION

1. Field of the Invention

The present invention relates to a chip resistor and a method of making the same. More specifically, the present invention relates to a chip resistor including an insulating substrate which is formed with a resistor layer and a pair of terminal electrodes for each end of the resistor layer, and a method of making such a chip resistor.

2. Description of the Related Art

Conventionally, a variety of chip resistors have been used. A typical chip resistor may include a small, rectangular supporting substrate on which a resistor layer having a required resistance is formed together with two terminal electrodes connected to the resistor layer. For protection of the resistor layer, a protective coating is formed on the substrate to cover the resistor layer.

The above-described chip resistor has been found disadvantageous in the following points. As stated above, the resistor layer is covered by the protective coating. As is often the case, the protective coating unduly bulges above the upper surface of each terminal electrode, so that the difference in height between the top portion of the protective coating and the upper surface of the terminal electrode may unfavorably be large.

With such a large height difference, the chip resistor may fail to be properly collected by a suction device (called "collet"), so that it may fall down onto the ground and be damaged. Another disadvantage is that when the resistor is mounted on a printed circuit board upside down (i.e., with the resistor layer located below the supporting substrate), the contacting surface of the resistor may not entirely come into contact with the circuit board. Consequently, some undesirable gap may be formed between the contacting surface of the resistor and the circuit board. The presence of such a gap is disadvantageous in properly connecting the chip resistor to the circuit board mechanically and electrically.

JP-A-4-102302 discloses a chip resistor arranged to overcome the above disadvantages. As shown in FIG. 9 and 10, the prior art chip resistor comprises an insulating substrate 1, a resistor layer 2 formed on the insulating substrate 1, a pair of terminal electrodes 3 (one electrode at each end of the resistor layer 2), and a glass protective coating 4 which includes an undercoat layer 4*a* formed directly on the resistor layer 2 and an overcoat layer 4*b* formed on the undercoat layer 4*a*. Each of the terminal electrodes 3 includes a main top electrode 3*a* in electrical conduction with the resistor layer 2, an auxiliary top electrode 3*b* formed on the main top electrode 3*a*, a side electrode 3*c* formed on the end face of the insulating substrate 1, and a plated metal layer 3*d* formed over the auxiliary top electrode 3*b* and the side electrode 3*c*.

The chip resistor described above can eliminate or at least alleviate the difference in height between each upper surface of the terminal electrodes 3 and the top portion of the protective coating 4.

As disclosed in JP-A-4-102302, the above chip resistor may be produced in the following manner.

First, each of the main top electrodes 3*a* is formed on the insulating substrate 1 by applying a silver paste which is thereafter dried and baked for fixation.

Then, the resistor layer 2 is formed on the insulating substrate 1 to bridge between the main top electrodes 3*a* by applying a material paste which is thereafter dried and baked for fixation.

Then, the undercoat layer 4*a* is formed on the resistor layer 2 by applying a glass paste which is thereafter dried and baked for fixation.

Then, the overcoat layer 4*b* is formed over the undercoat layer 4*a* by applying a glass paste which is thereafter dried and baked for fixation.

Then, each of the auxiliary top electrodes 3*b* is formed thick on a respective one of the main top electrodes 3*a* in contact with the overcoat layer 4*b* by applying a silver paste which is thereafter dried and baked for fixation.

Then, each of the side electrodes 3*c* is formed on a respective end face of the insulating substrate 1 by applying a silver paste which is thereafter dried and baked for fixation.

Finally, each of the plated metal layers 3*d* is formed over the auxiliary top electrode 3*b* and the side electrode 3*c*.

The above process has been found disadvantageous in the following points.

As stated above, each of the auxiliary top electrodes 3*b* is formed in contact with the overcoat layer 4*b*. However, according to the conventional process, the auxiliary top electrodes 3*b* will not be integrally attached to the overcoat layer 4*b*. Accordingly, in the step of forming the plated metal layer 3*d*, the metal plating solution may flow into the gaps between the overcoat layer 4*b* and each of the auxiliary top electrodes 3*b*. Further, the repeated heat treatments may generate undesirable space and cracks at the contact portions between the overcoat layer 4*b* and the auxiliary top electrodes 3*b*, thereby reducing the yield of nondefective resistors. In addition, e.g. the airborne substances such as sulfide may also flow into the gaps between the overcoat layer 4*b* and the auxiliary top electrodes 3*b*, whereby the main top electrodes 3*a*, which are made mainly of silver, may suffer sulfide corrosion. Consequently, the resistance of the chip resistor may unfavorably be altered. In an extreme case, the main top electrodes 3*a* may partly be decomposed to such an extent that their continuity is broken.

SUMMARY OF THE INVENTION

It is therefore an object of the present invention to provide a chip resistor which overcomes or reduces the above-described problems of the prior art chip resistor. Another object of the present invention is to provide a method of making such a chip resistor.

According to a first aspect of the present invention, a chip resistor having the following arrangement is provided. The chip resistor comprises an insulating substrate having a top surface, a spaced pair of main top electrodes formed on the top surface of the substrate, and a resistor layer formed on the top surface of the substrate to bridge between the main top electrodes. The chip resistor further comprises an overcoat layer formed over the resistor layer, and a spaced pair of auxiliary top electrodes each covering a respective one of the main top electrodes in contact with the overcoat layer. The overcoat layer is made of a glass material, and each of the auxiliary top electrodes contains a glass material in addition to a metal material.

With the above arrangement, since the auxiliary top electrodes contain the glass material, each of the auxiliary top electrodes is integrally attached to the overcoat layer when the auxiliary top electrodes are formed by baking. As a result, it is possible to prevent spaces and cracks from being formed between the overcoat layer and the auxiliary top electrodes. When the generation of the space and cracks is prevented in this manner, the main top electrodes are properly covered by the auxiliary top electrodes to be protected against e.g. sulfide corrosion which may otherwise be caused by the sulfide in the air.

In a preferred embodiment, the glass material of each said auxiliary top electrode is generally equal in softening point to the glass material of the overcoat layer.

Preferably, the glass material of each said auxiliary top electrode contains 50~75 wt % of PbO and 20~35 wt % of $SiO_2$.

Preferably, the glass material of the overcoat layer contains 50~75 wt % of PbO and 20~35 wt % of $SiO_2$.

In another preferred embodiment, the metal material of each said auxiliary top electrode comprises silver.

According to a second aspect of the present invention, there is provided a method of making a chip resistor which comprises the following steps. A spaced pair of main top electrodes are formed on a top surface of an insulating substrate by applying a metal paste which is thereafter dried and baked for fixation. A resistor layer is formed on the top surface of the insulating substrate to bridge between the main top electrodes by applying a material paste which is thereafter dried and baked for fixation. An overcoat layer is formed over the resistor layer by applying a glass paste which is thereafter dried and baked for fixation. A pair of auxiliary top electrodes are formed each on a respective one of the main top electrodes in contact with the overcoat layer by applying a metal paste which is thereafter dried and baked for fixation, wherein the metal paste contains a glass material.

According to the above-described method, since the metal paste for the auxiliary top electrodes contains the glass material, the glass material at each connecting portion melts and fuses with the overcoat layer when baked for forming the auxiliary top electrodes at a higher temperature than the softening point of the glass component of the overcoat layer and the softening point of the glass material in the metal paste for the auxiliary top electrodes. Therefore, the auxiliary top electrodes are integrally attached to the overcoat layer. That is, it is possible to prevent unfavorable space and cracks from being generated between the overcoat layer and the auxiliary top electrodes. Consequently, even if an additional layer, such as a plated metal layer, is formed over the auxiliary top electrode, the metal plating solution is prevented from reaching the main top electrodes covered by the auxiliary top electrodes and the overcoat layer. Similarly, the airborne sulfide cannot reach the main top electrodes, so that the corrosion of these electrodes by the sulfide is advantageously prevented.

Preferably, the glass material contained in the metal paste for the auxiliary top electrodes is generally equal in softening point to a glass component of the glass paste for the overcoat layer.

The metal paste for the auxiliary top electrodes may be baked at a higher temperature than said softening point after the glass paste for the overcoat layer is baked.

Alternatively, the metal paste for the auxiliary top electrodes may be baked at a higher temperature than said softening point simultaneously with baking the glass paste for the overcoat layer. In this way, since the overcoat layer and the auxiliary top electrodes are baked at the same time, the number of the baking steps are decreased which is advantageous in decreasing manufacturing cost.

In a preferred embodiment, the glass paste for the overcoat comprises glass frit which contains 50~75 wt % of PbO and 20~35 wt % of $SiO_2$.

Preferably, the glass material contained in the metal paste for the auxiliary top electrodes comprises glass frit which contains 50~75 wt % of PbO and 20~35 wt % of $SiO_2$.

Preferably, the glass frit is contained in a proportion of 0.3~15 wt % of the metal paste for the auxiliary top electrodes.

In another preferred embodiment, the metal paste for the auxiliary top electrodes contains silver particles having a specific surface area of no more than about 1.5 $m^2/g$.

Other features and advantages of the present invention will be become apparent from the detailed description given below with reference to the accompanying drawings.

DETAILED DESCRIPTION OF THE INVENTION

The preferred embodiment of the present invention will be described below with reference to accompanying drawings.

Figure 7:
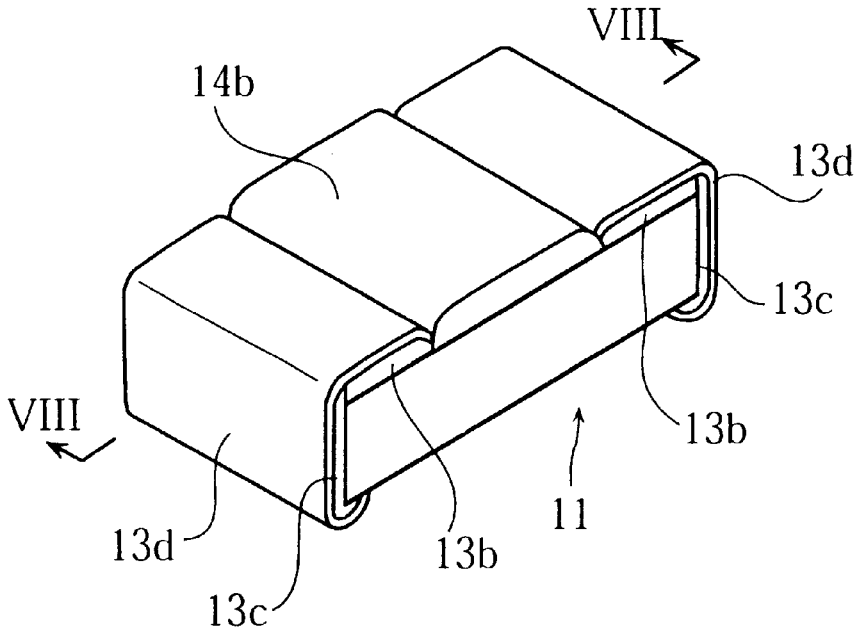
FIG. 7 is a perspective view of the chip resistor made by the method of the successive steps shown in FIGS. 1 through 6.
Figure 8:
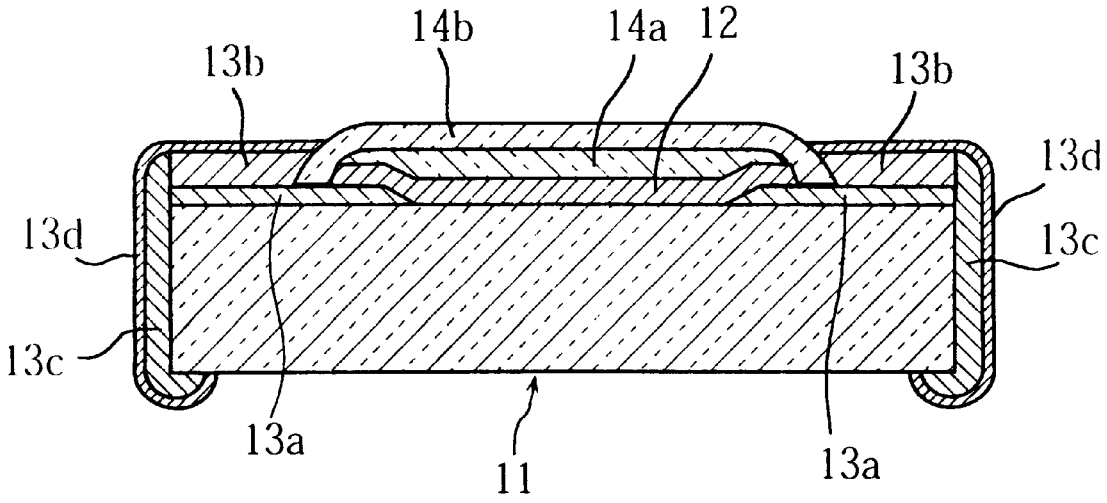
FIG. 8 is a sectional view taken along the line VIII—VIII in FIG. 7.
Figure 9:
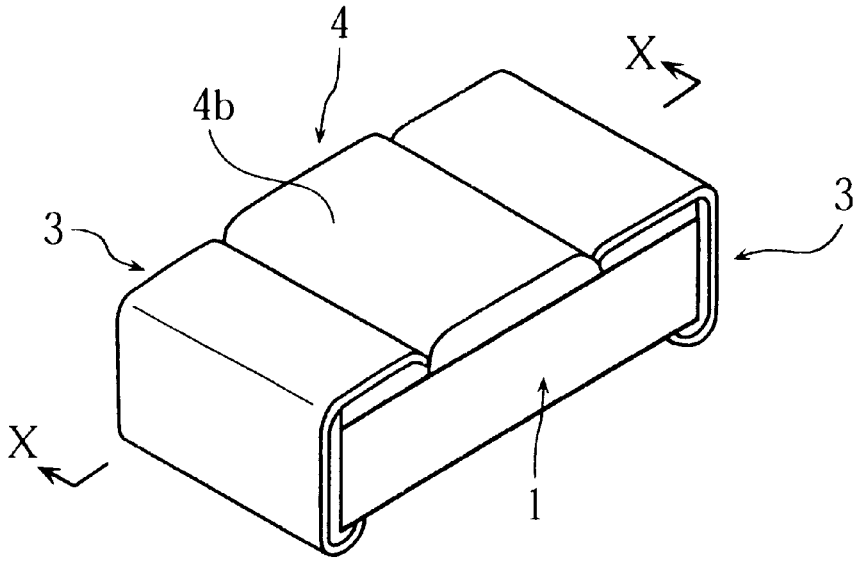
FIG. 9 PRIOR ART
FIG. 9 is a perspective view of a conventional chip resistor.
Figure 10:
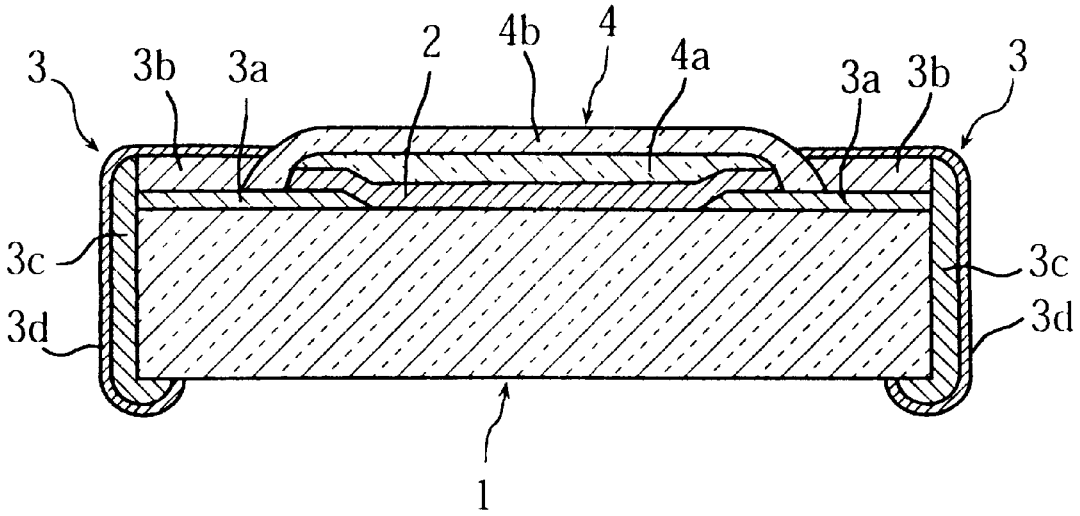
FIG. 10 PRIOR ART
FIG. 10 is a sectional view taken along the line X—X in FIG. 9.

FIGS. 7 and 8 of the accompanying drawings illustrate a chip resistor embodying the present invention. The chip resistor of this embodiment comprises an insulating substrate 11 made of an insulating material such as alumina or ceramic. The substrate is formed with a spaced pair of main top electrodes 13*a* located on the top surface of the insulating substrate 11, and a resistor layer 12 in electrical conduction with the main top electrodes 13*a*.

The resistor layer 12 is covered by a protective coating. This protective coating includes an undercoat layer 14*a* of glass formed directly on the resistor layer 12, and an overcoat layer 14*b* of glass formed on the undercoat layer 14*a*. The resistor layer 12 is subjected to laser trimming for resistance adjustment together with the undercoat layer 14*a*, as described hereinafter.

An auxiliary top electrode 13*b* is formed on each main top electrode 13*a* in electrical conduction therewith, wherein the auxiliary top electrodes contain a glass material in addition to a metal material.

A side electrode 13*c* is formed on each of the end faces of the insulating substrate 11 in electrical conduction with the corresponding main top electrode 13*a* and the corresponding auxiliary top electrode 13*b*. Further, the auxiliary top electrode 13*b* and the side electrode 13*c* at or adjacent to each end face of the insulating substrate 11 are covered by a plated metal layer 13*d* which includes a plated nickel layer and a plated solder (or tin) layer.

The chip resistor having the above-described structure may be advantageously produced in the following manner.

Figure 1:
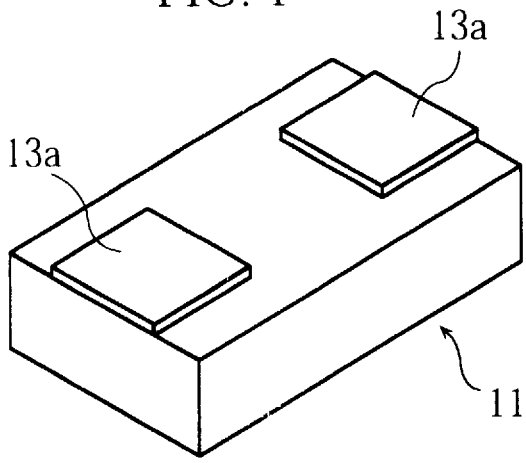
FIGS. 1 through 6 are perspective views showing the successive steps of making a chip resistor according to the present invention.

First, as shown in FIG. 1, each of the main top electrodes 13*a* is formed on the top surface of the insulating substrate 11 by applying a metal paste which is thereafter dried and baked for fixation. The metal paste contains silver particles having a specific surface area of about 3.5 $m^2/g$.

Figure 2:
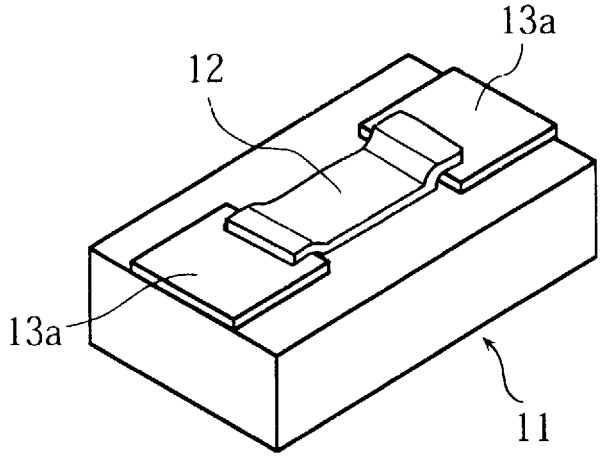

Then, as shown in FIG. 2, the resistor layer 12 is formed on the top surface of the insulating substrate 11 in partially overlapping relation to the respective main top electrode 13*a* by applying a material paste which is thereafter dried and baked for fixation. Alternatively, the resistor layer 12 may be formed before each of the main top electrodes 13*a* is formed.

Figure 3:
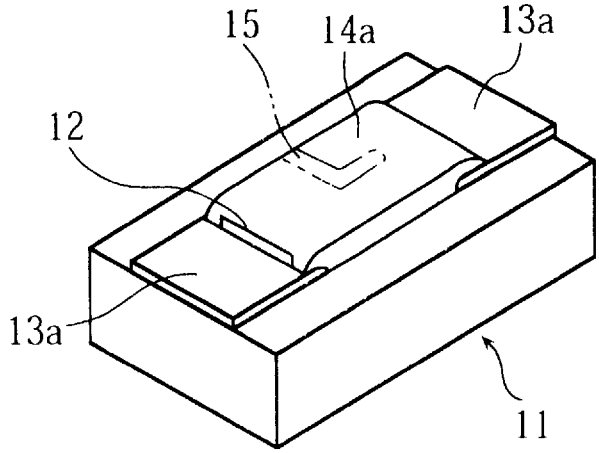

Then, as shown in FIG. 3, the undercoat layer 14*a* is formed on the resistor layer 12 by applying a glass paste which is thereafter dried and baked for fixation.

Then, while probes (not shown) are held in contact with the two main top electrodes 13*a* for resistance measurement, a trimming groove 15 is formed in the resistor layer 12 and the undercoat layer 14*a* by irradiating a laser beam until the measured resistance of the resistor layer 12 falls in a predetermined tolerable range.

Figure 4:
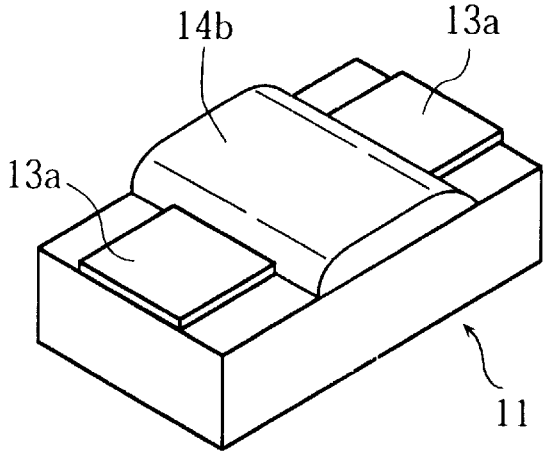

Then, as shown in FIG. 4, the overcoat layer 14*b* is formed over the undercoat layer 14*a* by applying a glass paste which is later dried and baked for fixation at a higher temperature than the softening temperature of the glass component in the glass paste. Preferably, the glass component in the glass paste for the overcoat layer 14*a* contains 50~75 wt % of PbO and 20~35 wt % of $SiO_2$, so that it has a softening temperature of about 540 to 570° C. Using such a glass component, the overcoat layer 14*b* is baked for fixation at about 600 to 620° C.

Figure 5:
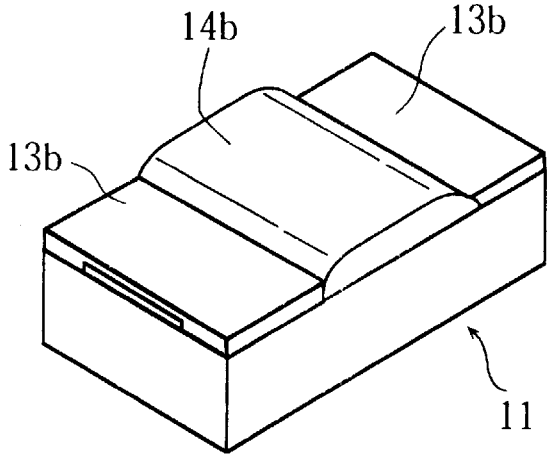

Then, as shown in FIG. 5, each of the auxiliary top electrodes 13*b* is formed on a respective one of the main top electrodes 13*a* by applying a metal paste which is thereafter dried and baked for fixation. Preferably, a silver paste is used as the metal paste and contains 0.3 to 15 wt % of the glass material. Preferably, the glass material contains 50~75 wt % of PbO and 20~35 wt % of $SiO_2$, so that it has a softening point of about 540 to 570° C. Using such a glass material, the auxiliary top electrodes 13*b* are baked for fixation at about 600 to 620° C.

Figure 6:
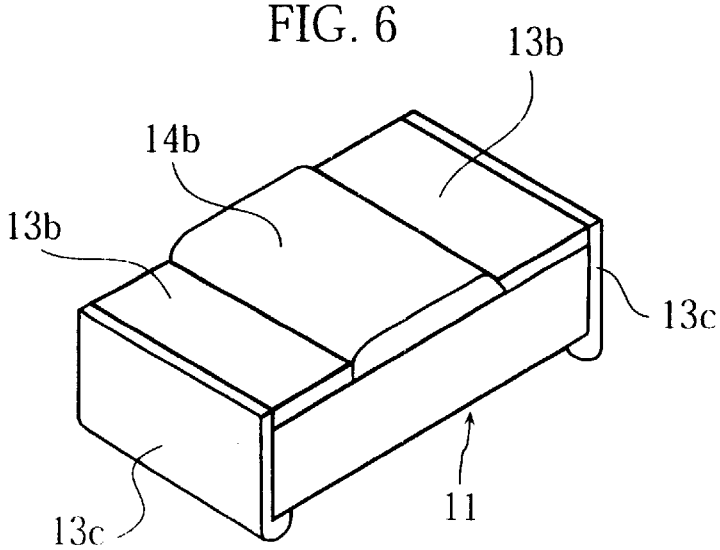

Then, as shown in FIG. 6, each of the side electrodes 13*c* is formed on a respective end face of the insulating substrate 11 by applying a metal paste which is later dried and baked for fixation.

Finally, as shown in FIGS. 7 and 8, each of the plated metal layers 13*d* is formed on the auxiliary top electrode 13*b* and the side electrode 13*c* by first plating with nickel followed by plating with solder (or tin).

According to the present invention, the metal paste for the auxiliary top electrodes 13*b* includes the glass material which is, preferably, generally equal in softening point to the glass component being used in the overcoat layer 14*b*, and is baked at a higher temperature than the softening point. In this way, the glass material in the metal paste for the auxiliary top electrodes 13*b* melts to fuse with the glass of the overcoat layer 14*b*, so that each of the auxiliary top electrodes 13*b* and the overcoat layer 14*b* are substantially integrated with each other at each contact portions. In the case that the glass paste for the overcoat layer 14*b* and the metal paste for the auxiliary top electrodes 13*b* are baked at the same time, they melt simultaneously to fuse with each other at their contact portions. As a result, the overcoat layer 14*b* and each of the auxiliary top electrodes 13*b* are formed integrally.

In another preferred embodiment, the glass component in the glass paste used for the overcoat layer 14*b* contains 50 to 75 wt % of PbO and 20 to 35 wt % of $SiO_2$, whereas the glass material in the metal paste used for the auxiliary top electrodes 13*b* contains 50 to 75 wt % of PbO and 20 to 35 wt % $SiO_2$. With such compositions, the glass component and the glass material both have securely almost the same softening point of about 540 to 570° C., so that the baking of them are carried out at about 600 to 620° C.

According to the present invention, each of the auxiliary top electrodes 13*b* is securely integrated with the overcoat layer 14*b*. Accordingly, it is possible to prevent space and cracks from forming at the contact portions between the overcoat layer 14*b* and the auxiliary top electrodes 13*b* during repeated heat treatments. Therefore, in the step of forming the plated metal layer 3*d*, the metal plating solution is reliably prevented from reaching the main top electrodes 13*a*.

According to the experiments performed by the inventors, it has been found that, when the auxiliary top electrodes 13*b* are made of silver paste including silver particles having a specific surface area of about 3.5 $m^2/g$ or an average diameter of about 1 $\mu$m just as the main top electrodes 13*a* and the side electrodes 13*c* are, the printed silver paste for each of the auxiliary top electrodes 13*b* contracts more rapidly and extensively than the printed glass paste for the overcoat layer 14*b*. Consequently, each of the auxiliary top electrodes 13*b* being formed tends to draw the overcoat layer 14*b* at a respective contact portion, thereby generating cracks on the overcoat layer 14*b* or partial peelings of the auxiliary top electrodes 13*b* from the overcoat layer 14*b*.

By contrast, when the auxiliary top electrodes 13*b* are made of silver paste including silver particles having a specific surface area of no more than 1.0 $m^2/g$ or an average diameter of 2 to 3 $\mu$m, the printed silver paste for each of the auxiliary top electrodes 13*b* contracts less and more slowly than the above case, thereby the above-mentioned cracks and peelings are much less likely to be generated.

The preferred embodiment being thus described, it is obvious that the present invention may be varied in many ways. Such variations should not be regarded as a departure from the spirit and scope of the present invention, and all such variations as would be obvious to those skilled in the art are intended to be included within the scope of the following claims.

What is claimed is:

1. A method of making a chip resistor comprising the steps of:

forming a spaced pair of main top electrodes on a top surface of an insulating substrate by applying a metal paste which is thereafter dried and baked for fixation;

forming a resistor layer on the top surface of the insulating substrate to bridge between the main top electrodes by applying a material paste which is thereafter dried and baked for fixation;

forming an overcoat layer over the resistor layer by applying a glass paste which is thereafter dried and baked for fixation; and forming a pair of auxiliary top electrodes each on a respective one of the main top electrodes by applying a metal paste which is thereafter dried and baked for fixation;

wherein only the metal paste for the auxiliary top electrodes contains a glass material.

2. The method according to claim 1, wherein the glass material contained in the metal paste for the auxiliary top electrodes is generally equal in softening point to a glass component of the glass paste for the overcoat layer.

3. The method according to claim 2, wherein the metal paste for the auxiliary top electrodes is baked at a higher temperature than said softening point after the glass paste for the overcoat layer is baked.

4. The method according to claim 2, wherein the metal paste for the auxiliary top electrodes is baked at a higher temperature than said softening point simultaneously with baking the glass paste for the overcoat layer.

5. The method according to claim 2, wherein the glass paste for the overcoat comprises glass frit which contains 50~75 wt % of PbO and 20~35 wt % of $SiO_2$.

6. The method according to claim 2, wherein the glass material contained in the metal paste for the auxiliary top electrodes comprises glass frit which contains 50~75 wt % of PbO and 20~35 wt % of $SiO_2$.

7. The method according to claim 6, wherein the glass frit is contained in a proportion of 0.3~15 wt % of the metal paste for the auxiliary top electrodes.

8. The method according to claim 1, wherein the metal paste for the auxiliary top electrodes contains silver particles having a specific surface area of no more than about 1.5 $m^2/g$.

* * * * *